US005371958A

United States Patent [19]

Brosseau

[11] Patent Number: 5,371,958

[45] Date of Patent: Dec. 13, 1994

[54] SHOWER SANDAL

[76] Inventor: Patrick Brosseau, 8 White Schoolhouse Rd., Rhinebeck, N.Y. 12572

[21] Appl. No.: 109,528

[22] Filed: Aug. 20, 1993

[51] Int. Cl.[5] ..... A43B 5/08; A43B 3/12

[52] U.S. Cl. ..... 36/8.1; 36/11.5; 36/115; 36/141

[58] Field of Search ..... 36/1, 3 B, 8.1, 11.5, 36/7.4, 7.1 R, 113, 115, 116, 141

[56] References Cited

U.S. PATENT DOCUMENTS

| | | | |
|---|---|---|---|
| 1,959,359 | 5/1934 | Hebig | 36/8.1 |
| 2,185,762 | 1/1940 | Cox | 36/8.1 |
| 2,486,886 | 11/1949 | Saukkonen | 36/8.1 |
| 3,559,309 | 2/1971 | Taylor | 36/7.3 |
| 3,605,292 | 9/1971 | Goldblatt | 36/8.1 |
| 3,640,006 | 2/1972 | Kendrick | 36/8.1 |
| 3,676,940 | 7/1972 | Shively | 36/8.1 |
| 3,724,107 | 4/1973 | Makinen et al. | 36/7.3 |
| 4,118,878 | 10/1978 | Semon | 36/8.1 |
| 4,215,491 | 8/1980 | Gianetti | 36/8.1 |
| 4,976,049 | 12/1990 | Myers | 36/8.1 |

*Primary Examiner*—Paul T. Sewell
*Assistant Examiner*—Marie Denise Patterson

[57] ABSTRACT

A shower sandal having an interior lined with a multiplicity of flexible protrusions and having suction cups on the underside to secure the sandal to the shower, the sandal being sufficiently large that the foot of the user can be moved about within the sandal against the flexible protrusions to clean and massage the various areas of the foot.

2 Claims, 1 Drawing Sheet

SHOWER SANDAL

BACKGROUND OF THE INVENTION

Various sandals have been proposed for wearing in a bath or shower. Such sandals, out of necessity, are of a waterproof nature and generally have been intended to protect the feet of the user from infection and also are frequently intended to prevent the user from slipping in the bath or shower.

The present invention offers these benefits. However, if other means such as a bath mat is provided to prevent slipping, it is possible to require only one sandal in the shower to clean and massage one foot at a time while the other foot is secured by the mat.

The present invention, in particular, is used for purposes of cleaning and massaging the feet making it possible for the user to scrub and massage the entire foot without bending over and with both feet on the shower floor. With the addition of an anti-bacterial soap, athletes foot and other such disorders can be eliminated.

SUMMARY OF THE INVENTION

The shower sandal according to the present invention, comprises essentially a sandal having a foot support member which is generally flat and having an upper enclosure, the upper enclosure being open at the toe and with a small opening at the heel and having the usual opening to permit placing the foot inside the enclosure. The enclosure is oversized, as is the foot support member, so that the foot of the user or wearer can move around within the sandal. The undersurface of the foot support member has suction cups to affix the sandal to the tub or shower to avoid the user slipping and the interior of the enclosure and the upper surface of the foot support member are covered with a multiplicity of flexible protrusions, such as brush bristles, to permit the user to clean and massage his entire foot. The openings at the toe and heel of the sandal permits water from the shower to flow out of the sandal, such water having entered through the opening where the foot is placed into the sandal. If only one sandal is used, by switching feet the user can clean each foot separately, but two sandals may also be used.

DESCRIPTION OF THE PREFERRED EMBODIMENT

Figure 1:
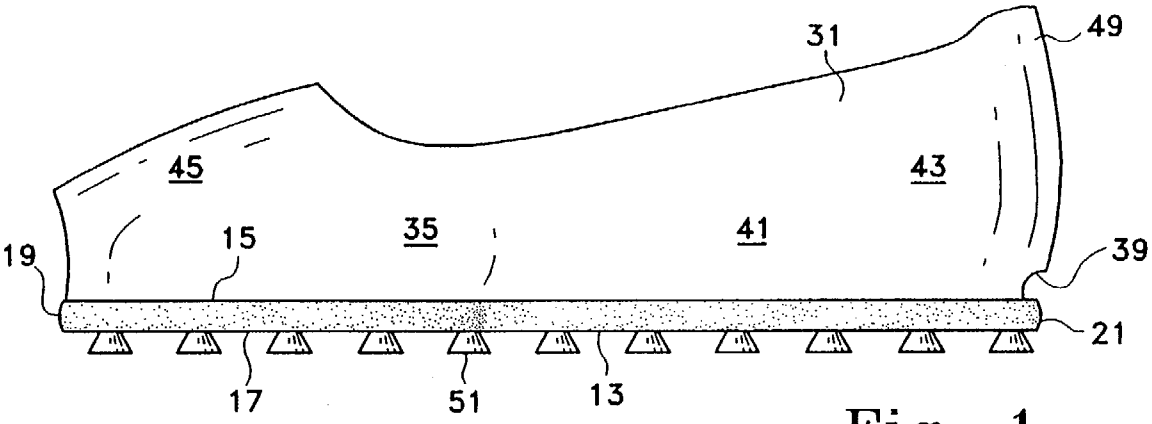
FIG. 1 is side elevation of the sandal showing the enclosure, and the foot support member with the suction cups beneath.
Figure 2:
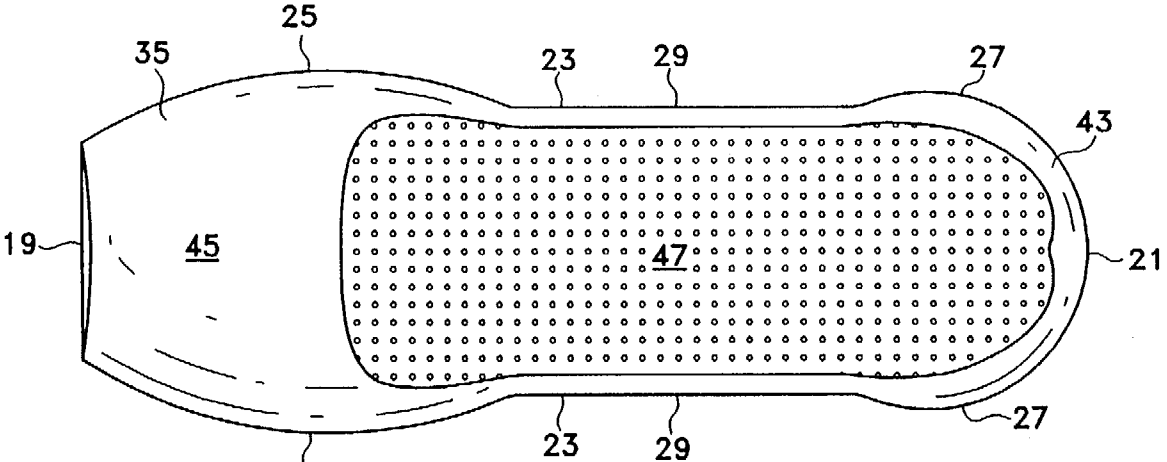
FIG. 2 is a top view of the invention showing the bristles on the foot support member through the opening in the enclosure where the foot is placed.
Figure 3:
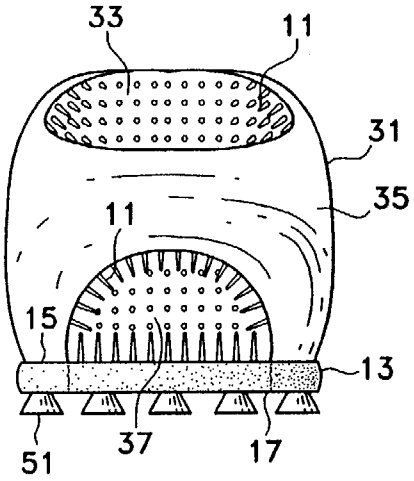
FIG. 3 is a front end view at the toe end of the sandal showing the suction cups on the foot support member and the enclosure with the flexible protrusions within the enclosure.

Referring now to the drawings a sandal is shown which is oversized and with flexible protrusions 11 within the sandal. The flexible protrusions 11 are preferably plastic bristles. The flexible protrusions 11 are preferably approximately 13/16 inches in length and would be in a range of ⅝ inch to 1 inch in length. The sandal includes a foot support member 13, which has an upper surface 15 and a lower surface 17 with a toe end 19 and a heel end 21 as well as two sides 23. The toe end 19 and the heel end 21 with the two sides 23 forms the periphery of the foot support member 13.

The toe end 19 is preferably blunt or straight and the heel end 21 is rounded. The foot support member 13 has a toe section 25 adjacent to the toe end 19 and has a heel section 27 adjacent to the heel end 21 of the foot support member 13. The foot support member 13 also has a center section 29 between the toe section 25 and the heel section 27 of the foot support member 13. The toe section 25 and the heel section 27 preferably have rounded sides while the center section 29 has straight sides. The toe section 25 is wider between the sides than the heel section 27 and the heel section 27 is wider between the sides 23 than the center section 29. Since the sandal is designed to be used by both the right foot and the left foot of the user, the foot support member 13 and the sandal are generally symetrical about their longitudinal centerline.

An upper enclosure 31 which is made of a flexible and waterproof material, has an inner surface 33 as well as an outer surface 35. The upper enclosure 31 is affixed to the foot support member 13 generally about the sides 23 and the heel end 21 of the foot support member 13. The upper enclosure 31 has an opening 37 adjacent to the toe end 19 of the foot support member 13. There is also a opening 39 at the heel end 21 of the upper enclosure 31 to permit drainage. The upper enclosure 31 has two side surfaces 41 adjacent to the sides 23 of the foot support member 13 and a heel surface 43 adjacent to heel 21 end and an upper surface 45 joining the two side surfaces 41 adjacent to the toe end 19 and above the toe section 25 of the foot support member 13. The upper enclosure 31 has an opening 47 above the center section 29 and heel section 27 of the foot support member 13 to permit the user to insert his foot into the enclosure. The opening 37 at the toe end 19 is substantially larger than the opening 39 at the heel end 21, and both such openings 21, 37 serve to permit water drainage from the sandal both during usage and in storage. The heel end 21 of the upper enclosure 31 extends from the foot support member 13 above the upper surface 45 of the upper enclosure 31 to form an extended surface 49 at the heel end 21 of the upper enclosure 31 for scrubbing the heel of the user's foot.

The multiplicity of flexible protrusions 11 preferably bristles, made of plastic, are mounted perpendicularly on the inner surface of the upper enclosure 31 and the upper surface 15 of the foot support member 13. In this way, the entire interior formed by the upper enclosure 31 and the foot support member 13 is covered with the flexible protrusions 11.

The upper enclosure 31 and the foot support member 13 substantially are oversized in comparison to any form fitting sandal or shoe so that a user using the device will place his foot in it and be able to move his foot around inside the interior of the upper enclosure 31 so as to rub the top of the foot against the flexible protrusions 11 and the sole of the foot as well as the sides and heel of the foot as the user may desire. In this way, the entire foot is cleaned removing dead skin and callous and the flexible protrusions 11 are also forced between the toes to reduce athlete's foot and other foot disorders. At the same time, the foot receives a stimulating massage.

A soap, preferably a germicide soap, may be supplied in liquid form to the upper enclosure to further assure elimination of any foot fungus.

To prevent the lower surface 17 of the foot support member 13 from slipping on the surface of the shower, a multiplicity of suction cups 51 are affixed to the lower surface 17 of the foot support member 13. Preferably, the suction cups 51 are molded as part of the foot support member 13. Each of the suction cups 51 is approximately ½ inch in diameter which has been found to be most satisfactory. The suctions cups 51 are located approximately one inch apart, center to center to provide adequate fastening strength. The suction cups 51 also facilitate vertical storage of the sandal on the shower wall when the sandal is not in use.

It is to be understood that the forms of the invention herewith shown and described are to be taken as preferred examples of the same, and that various changes in the shape and size and range of the parts may be resorted to, without departing from the spirit of the invention or scope of the sub-joined claims.

I claim:

1. A shower sandal oversized to permit a user to move his foot to various positions within the sandal for massaging and cleaning the foot of the user and also for securing the footing of the user in the shower, said shower sandal comprising:

A foot support member being generally flat and having an upper surface and a lower surface and having a toe end and a heel end and two sides, the toe end being straight and the heel end being rounded, the foot support member including a toe section adjacent to the toe end and a heel section adjacent to the heel end and a center section between the toe section and the heel section, the toe section and the heel section having rounded sides and the center section having straight sides, the toe section being wider between the sides than the heel section and the heel section being wider between the sides than the center section, the foot support member being generally symetrical about the longitudinal axis of the foot support member;

An upper enclosure affixed to the foot support member generally about the two sides and the heel end of the foot support member, the upper enclosure being open adjacent to both the toe end and the heel end of the foot support member and having two side surfaces adjacent to the sides of the foot support member and a heel surface adjacent to the heel end and an upper surface joining the two side surfaces, the upper surface having an opening above the center section and the heel section to permit the user to insert a foot into the enclosure, the upper enclosure having an inner surface, the opening adjacent to the toe end of the enclosure being substantially larger than the opening adjacent to the heel end;

A multiplicity of flexible protrusions mounted generally perpendicularly on the inner surface of the upper enclosure and the upper surface of the foot support member, the upper enclosure being sufficiently large to permit the user to move the foot of the user about the enclosure to massage and clean the foot of the user with the flexible protrusions, the flexible protrusions having a length on the range of ⅝th inch to 1 inch in length; and A plurality of suction cups mounted on the lower surface of the foot support member to secure the shower sandal to the shower.

2. A shower sandal according to claim 1 wherein the plurality of suction cups are located approximately one inch apart, center to center, and have approximately a one-half inch diameter.

* * * * *